United States Patent [19]

Maguire

[11] Patent Number: 4,713,911

[45] Date of Patent: Dec. 22, 1987

[54] AUXILIARY WINDOW LOCK

[76] Inventor: John B. Maguire, 1412 SW. 28 Ave., Deerfield Beach, Fla. 33441

[21] Appl. No.: 933,857

[22] Filed: Nov. 24, 1986

[51] Int. Cl.[4] ..... E05C 17/00

[52] U.S. Cl. ..... 49/394; 49/248

[58] Field of Search ..... 49/394, 450, 449, 458, 49/371, 248

[56] References Cited

U.S. PATENT DOCUMENTS

| | | | |
|---|---|---|---|
| 908,202 | 12/1908 | Carlson et al. | 49/450 X |
| 979,218 | 12/1910 | Stadtmuller | 49/449 X |
| 1,442,721 | 1/1923 | Gordon | 49/458 X |
| 1,950,311 | 3/1934 | Leghart | 49/449 X |
| 2,209,293 | 7/1940 | Cannon et al. | 49/450 X |
| 2,356,427 | 8/1944 | Pressnall | 49/449 X |
| 3,232,655 | 2/1966 | Foster | 49/449 X |
| 3,444,648 | 5/1969 | Anderson et al. | 49/394 X |
| 4,063,389 | 12/1977 | Leder | 49/449 X |
| 4,102,545 | 7/1978 | Jay | 49/450 X |

*Primary Examiner*—Philip C. Kannan
*Attorney, Agent, or Firm*—Oltman and Flynn

[57] ABSTRACT

A window assembly with a window movably mounted in a frame between closed and open positions has holes in the frame and the window which register with each other when the window is closed. A locking pin is slidably received in the registering holes to lock the window in its closed position.

6 Claims, 4 Drawing Figures

AUXILIARY WINDOW LOCK

SUMMARY OF THE INVENTION

This invention relates to an auxiliary lock for a window to prevent its being opened by a person from the outside.

On single family homes in particular, the windows are often vulnerable to entry by a burglar or other intruder because of inadequate locks. The present invention is directed to a novel, simple and practical solution to this problem in the form of an auxiliary lock which is readily applied to or released from a window from the inside of the building. In accordance with this invention a locking pin is slidably insertable at a location on the window which prevents it from being opened from the outside even if the principal lock for that window is disabled.

A principal object of this invention is to provide a novel auxiliary lock for a window to prevent it from being opened even if the principal window lock is disabled.

Further objects and advantages of this invention will be apparent from the following detailed description of a presently-preferred embodiment, which is illustrated in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

FIGS. 1-4

Figure 1:
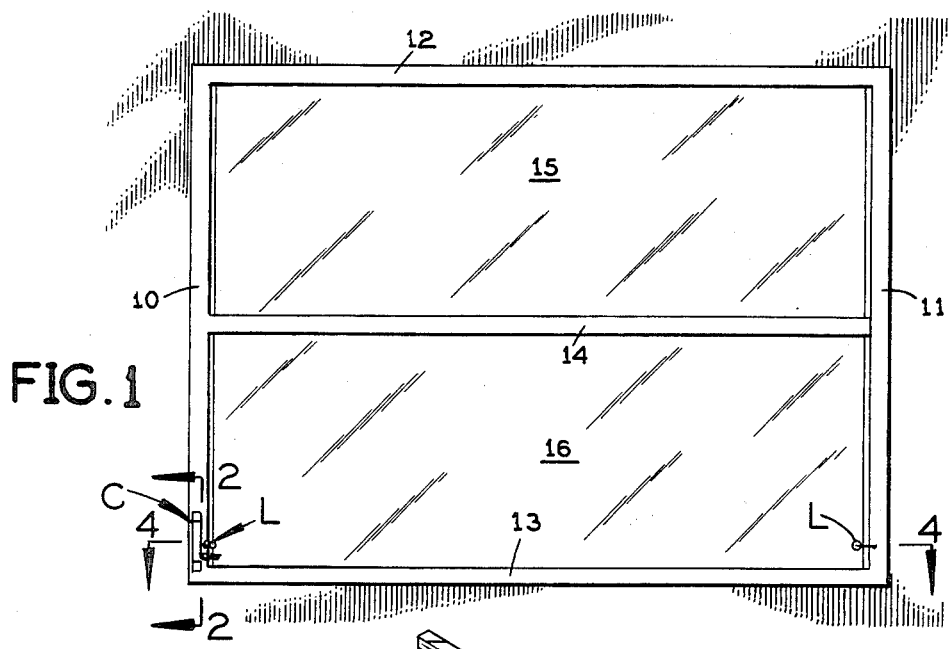
FIG. 1 is a front elevation of an awning window provided with the safety lock of the present invention.

FIG. 1 shows an awning window having a rectangular frame with opposite vertical sides 10 and 11, a horizontal top 12 and a horizontal bottom 13 which together define a rectangular window opening. As shown, the frame also has a horizontal middle piece 14 extending between the opposite sides 10 and 11 midway between the bottom and top pieces 13 and 12. However, it is to be understood that this middle piece is not present in the window frame of some types of awning windows. As shown, the window has two window panels, an upper panel 15 for closing the rectangular opening bounded by the top and middle pieces 12 and 14 and the opposite sides 10 and 11, and a lower panel 16 for closing the rectangular opening bounded by the middle and lower pieces 14 and 13 and the opposite sides 10 and 11.

Figure 3:
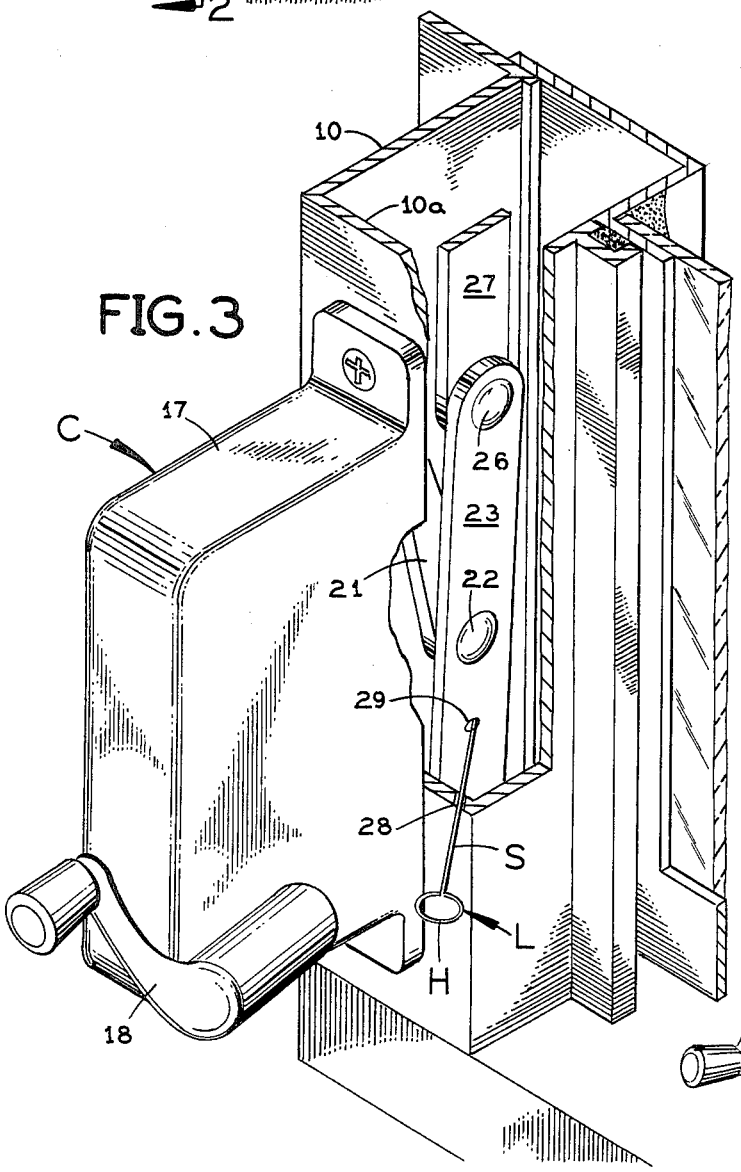
FIG. 3 is a perspective view of the crank and the window-operating linkage at this side of the window.

Both sides 10 and 11 are of hollow rectangular cross-section, as shown for the left side 10 in FIG. 3. A respective mechanical linkage is slidably disposed in each side and is coupled to both window panels 15 and 16 so that the window panels can be swung or rocked between vertical positions in which they close the respective openings in the window frame and inclined positions in which they extend at an acute angle to the vertical, with the upper end projecting beyond the frame on the outside of the building.

A hand-operated crank C (FIG. 1) is mounted on the lower left side of the window frame at the inside of the building. As shown in FIG. 3, this crank is in a housing 17 which is attached by screws to the inside wall **10*a* of the window frame's left side 10. A rotatable crank member 18 operates a rigid first linkage arm 19 (FIG. 2) through a gear-toothed drive arrangement (not shown) inside the housing 17**.

Figure 4:
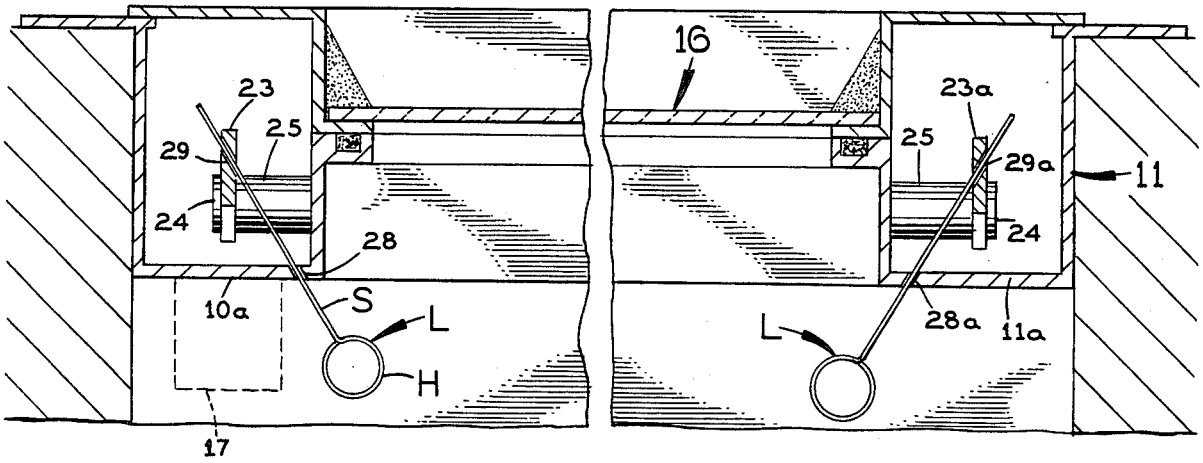
FIG. 4 is a horizontal cross-section taken along the line 4—4 in FIG. 1, with parts removed.

The first linkage arm is pivotally coupled at 20 to a depending second linkage arm 21. The lower end of arm 21 is pivotally coupled at 22 to a longer third linkage arm 23. The pivotal connection between arms 21 and 23 is slightly more than half-way up linkage arm 23. The lower end of this third linkage arm is rigidly attached to a horizontal shaft 24 which is rotatably mounted in a cylindrical bushing 25 (FIG. 4). Both shaft 24 and bushing 25 extend through the hollow bottom piece 13 of the window frame from the left side 10 to the right side 11.

At the right side of the window frame the rotatable shaft 24 is rigidly attached to the lower end of a rigid linkage arm **23*a* (FIG. 4) which is identical to the third linkage arm 23 at the left side. At the right side there is no crank and there are no linkage arms corresponding to the first and second linkage arms 19 and 21 at the left side. The rotatable shaft 24 causes linkage arm 23*a* at the right side to move in unison with linkage arm 23** at the left side, both in response to operation of the hand crank.

Linkage arm 23 at the left side is pivotally coupled at 26, near its upper end and above its pivotal connection at 22, to linkage arm 21, to the lower end of a fourth linkage arm 27. Similarly, linkage arm **23*a* at the right side of the window is pivotally coupled at its upper end to the lower end of a linkage arm (not shown) which is identical to linkage arm 27** at the left side of the window.

The remaining parts of the window-operating linkage on each side of the window need not be described in detail because they are of known, conventional design.

Figure 2:
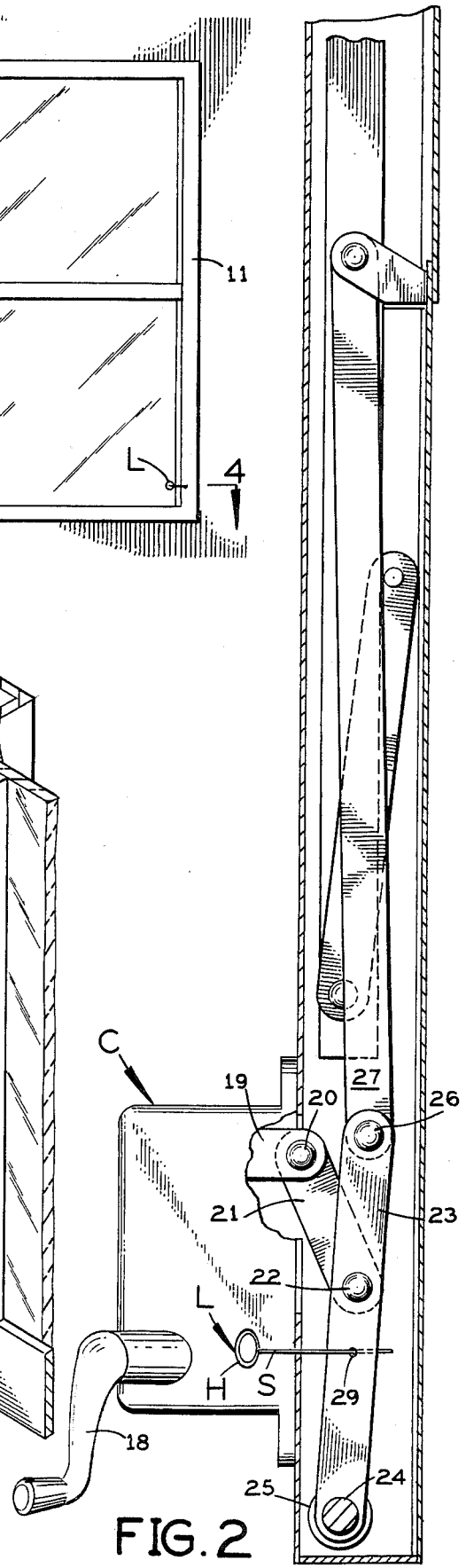
FIG. 2 is an enlarged vertical cross-section taken along the line 2—2 in FIG. 1 at the side of the window where the crank is located.

To open the windows, the user turns the crank handle 18 in a direction for moving the linkage arm 23 counterclockwise in FIG. 2. This movement of linkage arm 23 at the left side of the window is imparted through shaft 24 to the corresponding linkage arm **23*a* at the right side, and the additional parts of the linkages on the left and right sides of the window move in response to this displacement of linkage arms 23 and 23*a***.

In accordance with the present invention, the linkage arm 23 near the manually operated crank C at the left side of the window can be locked in its window-closing position, shown in FIGS. 2 and 3, by a locking pin L, which has an elongated straight shank or stem 5 and a handle H of circular shape at one end. A horizontal hole 28 (FIG. 3) is drilled through the front wall **10*a* of the left side piece 10 of the fixed frame for the window a short distance laterally inward from (i.e. to the right of) the window crank housing 17. A similar hole 29 is drilled through linkage arm 23. The two holes 28 and 29 are aligned with one another. The respective axes of these holes extend at an acute angle, such as about 45 degrees, to the front wall 10*a* of the frame side piece 10, so that the shank of the locking pin L can be inserted first through the hole 28 in the frame and then through the opening 29 in linkage arm 23. The shank S of the locking pin has a snug, sliding fit in these holes. When inserted, as shown in FIGS. 2–4, the locking pin prevents the linkage arm 23** from moving so that the hand crank C cannot be operated.

As shown in FIG. 4, at the right side of the window an identical locking pin L may be inserted through aligned horizontal holes 28*a* and 29*a* in the front wall 11*a* of the right side 11 of the window frame and in the linkage arm 23*a*, respectively. The conjoint axes of holes 28*a* and 29*a* extend at an acute angle to the front wall 11*a* of the window frame side 11 which is equal and opposite to the angle of the conjoint axes of holes 28 and 29 in the window frame side piece 10 and the linkage arm 23 at the left side.

I claim:

1. In combination with an awning window having:

a frame bordering a window opening;

a plurality of window panels in said frame in succession vertically;

and a mechanical linkage operatively coupled to said panels for adjusting said panels between substantially vertical closed positions and open positions at acute angles to the vertical, said linkage including a movable rigid linkage arm which in one position causes said linkage to position said window panels in their closed positions;

the improvement wherein:

said linkage arm and said window frame adjacent said linkage arm have holes which are aligned in said one position of said linkage arm;

said improvement further comprising:

a locking pin snugly but slidably insertable in and removable from said aligned holes in the window frame and said linkage arm in said one position of said linkage arm.

2. The combination of claim 1 wherein:

said frame copmrises vertically elongated side pieces on opposite sides of said window opening, at least one of said frame side pieces having an exposed front wall near said linkage arm;

said hole in the frame extends substantially horizontally through said front wall at an acute angle;

and said hole in said linkage arm extends substantially horizontally in alignment with said hole in the front wall of the frame in said one position of said linkage arm.

3. The combination of claim 2 and further comprising:

a manually operable crank operably coupled to said linkage arm for moving said linkage arm, said crank being mounted on said front wall of said one side piece of the window frame close to said hole therein.

4. The combination of claim 3 wherein:

said crank is positioned laterally outward from said hole in said front wall of said one side piece of the window frame.

5. In combination with an awning window having:

a rectangular frame bordering a window opening and having vertically elongated side pieces on opposite sides of the window opening, each of said side pieces having an exposed front wall;

a plurality of window panels mounted in said frame in succession vertically;

a manually operable crank mounted on the front wall of one of said side pieces of the window frame near its lower end;

and a mechanical linkage inside said one side piece of the window frame operatively engaged between said crank and said window panels for adjusting said window panels in accordance with the position of said crank between substantially vertical closed positions and open positions at acute angles to the vertical, said linkage including a movable linkage arm close to said front wall of said one side piece of the window frame, said linkage arm in one position thereof causing said linkage to position said window panels in their closed positions;

the improvement wherein:

said linkage arm and said front wall of said one side piece of the window frame have substantially horizontal holes which are aligned in said one position of said linkage arm, said holes extending at an acute angle to said front wall, said hole in the front wall of said one side piece of the window frame being located a short distance laterally inward from said crank;

said improvement further comprising:

a locking pin snugly but slidably receivable in said holes in the window frame and said linkage arm when said linkage arm is in said one position, whereby to lock said linkage arm against movement.

6. The combination of claim 5 and further comprising:

a second mechanical linkage inside the other of said side pieces of the window frame operatively engaged between said mechanical linkage inside said one side piece and the window panels for adjusting said window panels, said second mechanical linkage including a movable second linkage arm close to said front wall of said other side piece the window frame near its lower end, said second linkage arm having a predetermined position when said one linkage arm is in said one position thereof;

said second linkage arm and said front wall of said other side piece of the window frame having substantially horizontal holes which are aligned in said predetermined position of said second linkage arm, said last-mentioned holes extending at an acute angle to said front wall of said other side piece, said hole in said front wall of said other side piece being located laterally inward from said second linkage arm;

and a second locking pin snugly but slidably receivable in said holes in the second linkage arm and said front wall of said other side piece of the window frame when said second linkage arm is in said predetermined position, whereby to lock said second linkage arm against movement.

* * * * *